US009920512B1

(12) United States Patent
Eisold et al.

(10) Patent No.: US 9,920,512 B1
(45) Date of Patent: Mar. 20, 2018

(54) TRANSFORMATION OF SHIPPING CONTAINERS TO TWO LEVEL BUILDINGS

(71) Applicant: Cakeboxx Technologies, LLC, McLean, VA (US)

(72) Inventors: Daine Edward Eisold, McLlean, VA (US); Christopher Paul Clark, Canterbury (GB)

(73) Assignee: Cakeboxx Technologies, LLC, McLean, VA (US)

( * ) Notice: Subject to any disclaimer, the term of this patent is extended or adjusted under 35 U.S.C. 154(b) by 0 days.

(21) Appl. No.: 15/148,029

(22) Filed: May 6, 2016

Related U.S. Application Data

(60) Provisional application No. 62/160,221, filed on May 12, 2015.

(51) Int. Cl.
*E04H 1/12* (2006.01)
*E04B 1/343* (2006.01)
*E04H 1/04* (2006.01)

(52) U.S. Cl.
CPC ..... *E04B 1/343* (2013.01); *E04H 1/04* (2013.01); *E04H 1/12* (2013.01); *E04B 2001/34394* (2013.01); *E04H 2001/1283* (2013.01)

(58) Field of Classification Search
CPC ..... E04H 1/04; E04H 2001/1283; E04H 1/12; E04B 1/343; E04B 2001/34394
See application file for complete search history.

(56) References Cited

U.S. PATENT DOCUMENTS

| | | | | |
|---|---|---|---|---|
| 2,538,736 | A * | 1/1951 | Spencer | B60P 3/34 296/171 |
| 2,556,418 | A | 6/1951 | Del Mar | |
| 2,920,781 | A | 1/1960 | Butcher | |
| 3,042,227 | A | 7/1962 | Tantlinger | |
| 3,088,619 | A | 5/1963 | Boucher | |
| 3,261,493 | A | 7/1966 | Smith | |
| 3,374,915 | A | 3/1968 | Verhein | |
| 3,529,741 | A | 9/1970 | Walker | |
| 3,568,912 | A | 3/1971 | de simas | |
| 3,584,757 | A | 6/1971 | Blaisdell | |
| 3,602,376 | A | 8/1971 | DePiano | |
| 3,760,970 | A | 9/1973 | Lutz | |
| 3,797,691 | A | 3/1974 | Williams, Jr. | |
| 3,853,238 | A | 12/1974 | Luisada | |
| 3,872,555 | A | 3/1975 | Link | |
| 3,908,852 | A | 9/1975 | Ricobene | |
| 4,010,990 | A | 3/1977 | Rowley | |
| 4,015,715 | A | 4/1977 | Kelf | |

(Continued)

FOREIGN PATENT DOCUMENTS

| | | | |
|---|---|---|---|
| DE | 20201657 | U1 | 6/2002 |
| FR | 2956859 | A1 | 9/2011 |
| GB | 2089768 | A | 6/1982 |

*Primary Examiner* — Andrew J Triggs
(74) *Attorney, Agent, or Firm* — James Creighton Wray; Meera P. Narasimhan

(57) ABSTRACT

An extendable two story building is packaged within the standard dimensions of an intermodal container. An upper floor is supported above a lower floor. A five-sided lid is raised and locked to provide a second story. The lid is lowered and locked on a base in a down position. The lowered lid is fully enclosed so that no door is accessible and the interior of the building is secure during storage and transportation.

13 Claims, 14 Drawing Sheets

(56) References Cited

U.S. PATENT DOCUMENTS

| | | | | |
|---|---|---|---|---|
| 4,120,415 | A | 10/1978 | Hopkins | |
| 4,209,887 | A | 7/1980 | Saunders | |
| 4,355,732 | A | 10/1982 | Nessfield | |
| 4,360,115 | A | 11/1982 | Saunders | |
| 4,416,385 | A | 11/1983 | Clare | |
| 4,546,896 | A | 10/1985 | Reid | |
| 4,809,851 | A | 3/1989 | Oestreich, Jr. | |
| 4,936,451 | A | 6/1990 | Shuert | |
| 5,832,676 | A * | 11/1998 | Gillmore | E04B 1/3431 248/654 |
| 8,002,134 | B2 | 8/2011 | Whyte | |
| 9,060,652 | B2 * | 6/2015 | Bikker | A47K 4/00 |
| 9,366,019 | B2 * | 6/2016 | Bikker | A47K 4/00 |
| 2005/0262778 | A1 * | 12/2005 | Allen | E04B 1/34815 52/79.1 |
| 2005/0284035 | A1 * | 12/2005 | DeOvando | E04B 1/3431 52/79.1 |
| 2007/0246466 | A1 | 10/2007 | Whyte | |

* cited by examiner

TRANSFORMATION OF SHIPPING CONTAINERS TO TWO LEVEL BUILDINGS

This application claims the benefit of U.S. Provisional Application No. 62/160,221, filed May 12, 2015, which is hereby incorporated by reference in its entirety as if fully set forth herein.

SUMMARY OF THE INVENTION

The invention is a manifestation of a frame-based structure incorporating a system of support beams, brackets, welds and bolts that when used in conjunction with a lid and deck components create a portable, mobile structure extendable to a two-story level when fully open, and capable of being easily secured, stored and transported when fully closed and locked.

The invention includes frames and support mechanisms constructed of steel, other metal or composite material used in conjunction with suitable decks or a foundational platform and a five-sided lid-type structure will form in one application a portable one or two story structure suitable for use as a domicile, office or similar operational facility for human or mechanical activity, or in another application a storage facility for equipment or vehicles in a garage-type application.

The framework of the building structure will be suitably anchored to a deck or foundation platform and will be built to a size that dimensionally fits securely within the internal dimension of the lid-type structure. This lid-type structure can be of any fabricated nature that is suitable to this purpose, such as a corrugated metal shipping container or purpose-built design.

The new building structure is outfitted with mechanical stops and attachment points. When the lid is lifted, the mechanical stops limit the vertical travel of the lid to a pre-defined height, and mechanical supports with locking tabs in the structure are deployed to engage the bottom edges of the lid and to lock it securely into position and hold it in position. Swung-out brackets are located towards the top of the four-corner post frame. These brackets are swung out to a 90 degree angle from their stored position to form the support for the lid while in a lifted position. Internal bolts that are also part of the frame are then slotted into aligned holes or pockets in the lid to secure it in place.

The swing out brackets may be used in conjunction with connectors on bottom corners of the lid which are bolted to the four-corner post frame. Alternatively, connectors on bottom corners of the lid which are bolted to the four-corner post frame may be used without the swing out brackets.

In another configuration, in addition to the stop and securing mechanism described above, the building structure can be outfitted with a commercially available hydraulic or pneumatic lifting mechanism positioned between the end posts. In this configuration the new hydraulic or pneumatic lifting mechanism structure will function as both the lifting and lowering apparatus for the building top level and may function as the securing apparatus for the entire lid component.

An internal first floor is provided within the inner section, and a second level floor is secured to the top of the inner section. An opening in the second level floor and a staircase in the inner section provide access to the upper level.

Water, electrical and drain connections, holding tanks and interior facilities and furnishings may be provided in the lower level.

Within the framework of the new building structure suitable habitability or functional space can be built-out to accommodate these functions. The top portion of the new building structure is designed to function as both the ceiling of any space built out within the four sides of the structure and also as the floor of 'second-story' space that may be built in above it.

There is a large global market for portable and transportable housing, office space, operational facilities, medical, sanitary facilities, restaurants, coffee shops, emergency response facilities, and parking and storage facilities. The new building structure will provide a solution to many of these problems and fill many of these needs.

The new building can be used for work/living space, is fully portable, has the same footprint as a standard container, is simple to transport and install, is easy to open and close and can be customized to a client's exact needs.

The raising of the portable enlargeable building upper level can be either by conventional container lift methods or by an integral hydraulic lift system as an option. All the lifting and locking is made simple and secure to minimize handling and maintenance requirements and reducing installation costs while maximizing site space and use.

When not in use, the portable enlargeable building can be fully closed and locked as with a normal two piece deck and lid designed shipping container and stored or shipped ready for its next task or application. Due to the fact that there are no doors or windows accessible when fully shut down, the portable enlargeable building is protected against vandals and theft of contents.

The new portable enlargeable building provides a missing solution for the needs and requirements of many key industries and organizations.

The intermodal new shipping container building uses deck and lid technology as described in U.S. Provisional Patent Application 62/259,104 filed Nov. 24, 2015, which is incorporated herein by reference as if fully set forth herein. The new deck and lid technology use a planar base with corner castings and twist locks to engage and secure complementary corner castings on a five-sided lid. The solid lid and base corner casting locks make the container, and in this case the building, secure against vandals, thieves and unauthorized users.

Companies or organizations that will be interested in the new transportable building structure for use in the main as temporary accommodations or for specific equipment or service use can include the building and general construction/services industry, the oil, mining and gas industry, humanitarian shelter welfare, medical and disaster support, event market, pop up shops, catering, bespoke market and the defence/military market.

An upward extensible building has a base frame with longitudinal side beams and end beams and cross beams extending between the longitudinal beams. The cross beams include end beams extending between ends of the side beams and intermediate beams extending between longitudinal beams spaced from the end beams. A lower floor is mounted on the cross beams. Vertical columns have lower ends connected to the base frame. An upper frame is connected to the upper ends of the vertical columns. A lid is positioned around the vertical columns for moving upward to provide an upper level and downward to close the upper level. Connectors are connected to the lid for securing to the vertical columns and hold the lid in an upward position. Locks connect to the lid and the base frame for holding the lid in a downward position.

An upper floor is connected to the upper frame. A passageway is provided between the lower floor and the upper floor. Outer lower walls are connected to the vertical columns. An entry door is connected to one of the outer walls. The lid provides outer upper walls.

A barrier is erectable in the upper level for separating the passageway from the upper floor. Windows are provided in the walls.

A bathroom is on the lower floor. Plumbing connections and tanks are in a space below the stairs. Small doors in the outer lower wall allow access to the plumbing connections and tanks.

The lid locked in the downward position surrounds the lower walls and prevents access to the extensible building through the doors or windows.

The lid is a five-sided structure with a roof and four walls and vertical pillars in corners of the walls. The pillars slide over the vertical columns. Lid corner castings are connected to tops and bottoms of the vertical pillars. Base corner castings are connected to corners of the base frame. Locks connect base corner castings with lid corner castings.

The extensible building has a size comparable to an intermodal shipping container for transporting and for stacking with another similar extensible building.

The extensible building is provided with a toilet, sink and shower and home or office furnishings on the lower floor. Furnishings stored on the lower floor are moved through the passageway to the upper floor when the lid is secured in the upper position.

These and further and other objects and features of the invention are apparent in the disclosure, which includes the above and ongoing written specification, with the claims and the drawings.

DETAILED DESCRIPTION

Figure 1:
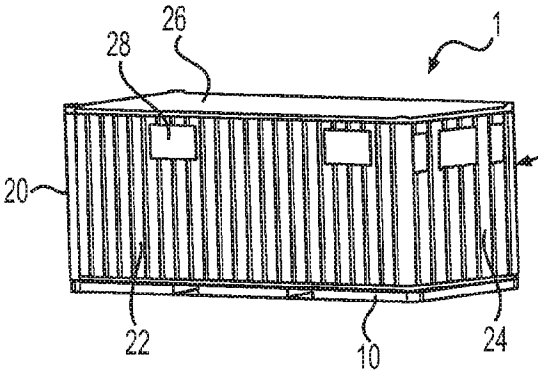
FIG. 1 is a perspective view of the new container building ready for transporting to a location.

FIG. 1 is a perspective view of the new container building 1 in a transportation condition 2 ready for transporting to a location.

The container building 1 has a base 10 and a lid 20. The lid has side walls 22, end walls 24 and a roof 26. Windows or window openings 28 are provided in the lid.

FIGS. 2-6 are perspective views of the new container building showing sequences of raising the lid 20 from the base 10.

Figure 2:
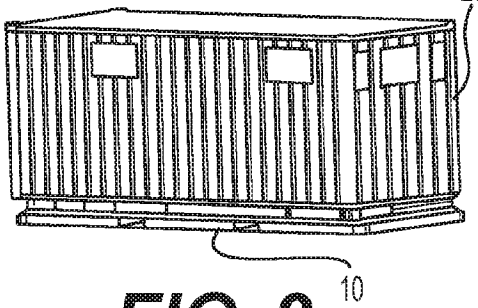
FIGS. 2-6 are perspective views of the new container building showing sequences of raising the top floor from the bottom floor.

In FIG. 2 lid 20 has been unlocked and unlatched from the base 10. The lid 20 is shown in the initial stages of lifting. The base 10 remains resting on the ground or a prepared surface while the lid 20 is lifted.

Figure 3:
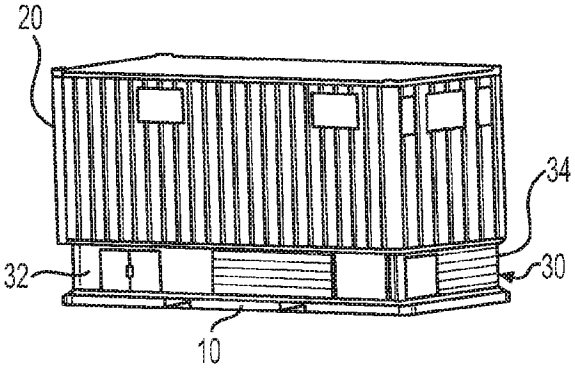

FIG. 3 shows the lid 20 partially lifted, exposing an inner shell 30 that encloses a lower floor area. The inner shell 30 has sides 32 and end walls 34 which enclose the lower floor living area. A bottom of an entry door 42, windows 44 and small doors 46 covering a recessed utilities connections panel are shown. Sides 32 and end walls 34 of the inner shell 30 are constructed and decorated to resemble side walls of neighboring buildings.

Figure 4:
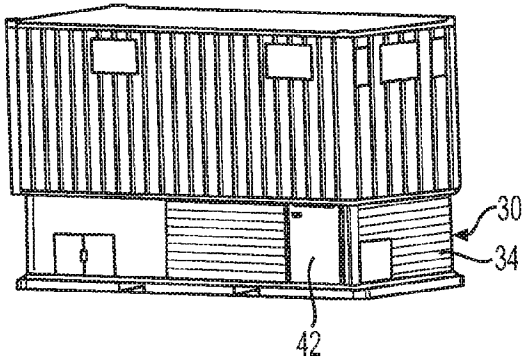
Figure 5:
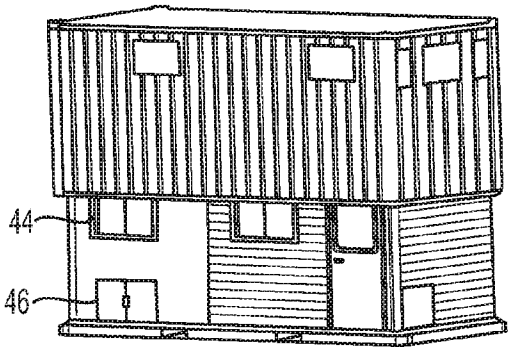
Figure 6:
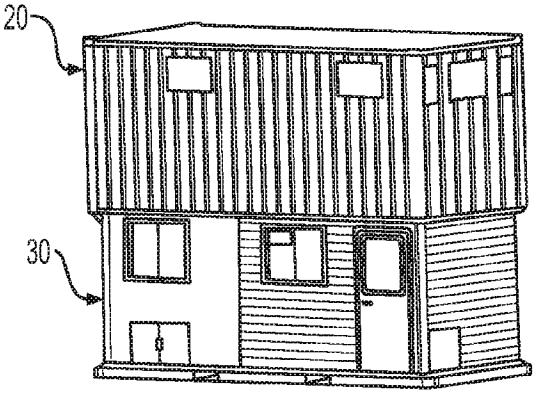

FIGS. 4, 5 and 6 show continued raising of the lid 20 until the entire lower shell 30, door 42 and windows 44 appear and the lid 20 is in its uppermost position.

Windows 44 may be glazed and ready to use. Windows or window openings 28 in lid 20 may be ready to accept bolted-in window frames which are packed and shipped inside the lower shell 30 and accessed by door. Window frames with sliding or outward turning windows may be packaged and secured on the upper floor. The upper floor is mounted on tops of upper horizontal support frames of the inner shell 30.

The inner shell has interior fixtures, features and furnishings held in place on a lower floor connected to base 10.

Figure 9:
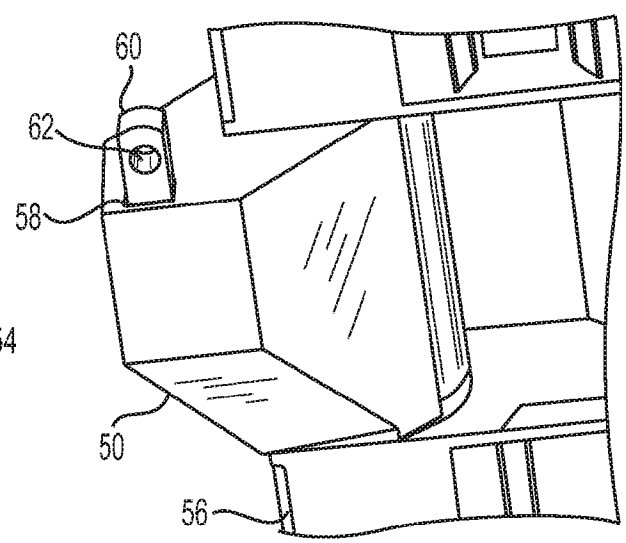
FIGS. 7-9 show a swung-out corner support for the raised top floor in stowed position, in swung-out position and with a raised top floor locking tab extended for use.
Figure 8:
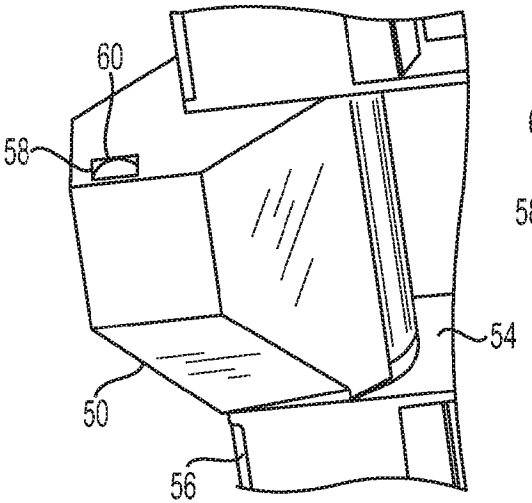
Figure 7:
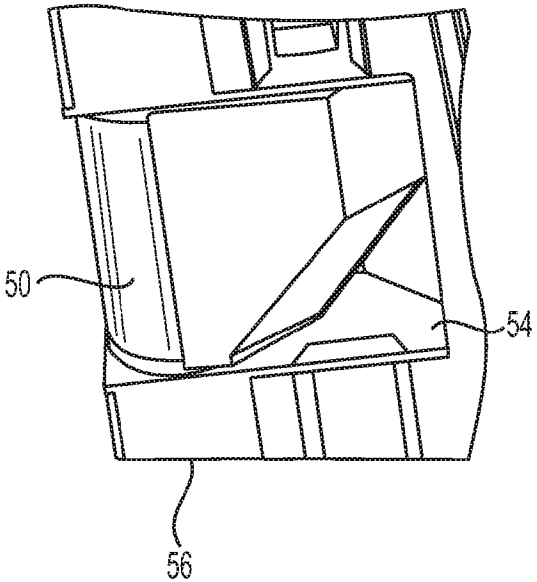

FIGS. 7-9 show a swung-out corner support 50 for the raised top floor area enclosing lid 20. The supports 50 are shown in stowed position, in swung-out position and with a raised top floor locking tab or lug 60 extended for use.

FIG. 7 shows the support 50 in stowed position 52 on a vertical axle within a pocket or recess 54 near a top of a vertical support beam 56.

FIG. 8 shows the support 50 turned 90° to an outward position 56 for supporting the lid 20 in a raised position. An opening 58 in a top of each support 50 holds a liftable locking lug 60.

FIG. 9 shows the support 50 turned 90° to a position 56 for supporting the lid 20 in a raised position. The lifted locking lug 60 has an opening 62 to receive a bolt or a slidable locking bar connected to lid 20.

FIGS. 10-18 are corner details showing sequences of turning the corner support 50, raising the locking tab 60 and extending ends 72 of locking bars 70 into the openings 62 in the locking tabs 60.

Figure 10:
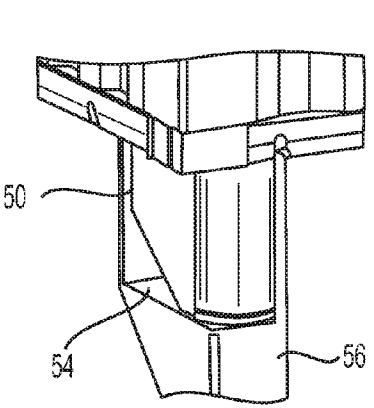
FIGS. 10-18 are corner details showing sequences of turning the corner support, raising the locking tab and extending ends of the locking bar ends into the locking tabs.
Figure 11:
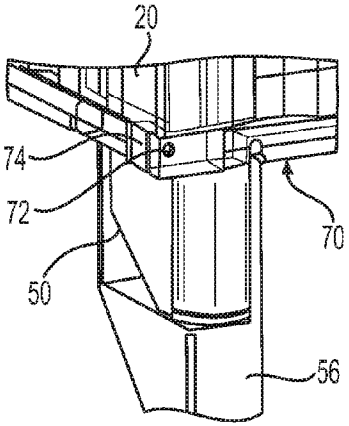

FIGS. 10 and 11 show the supports 50 stowed inward in the recesses 54 in vertical support beams 56.

FIG. 11 is cut away to show the lower box beams 70 in lid 20 and an end 72 of sliding locking bar 74.

Figure 12:
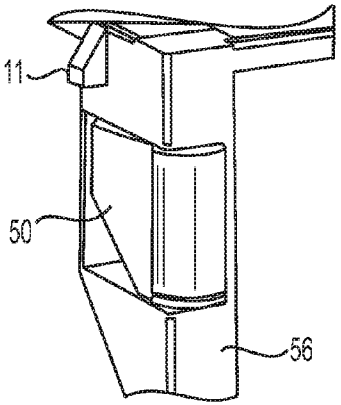
Figure 13:
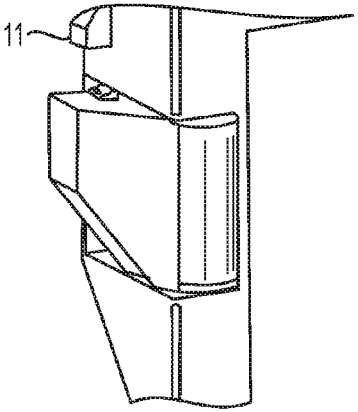
Figure 14:
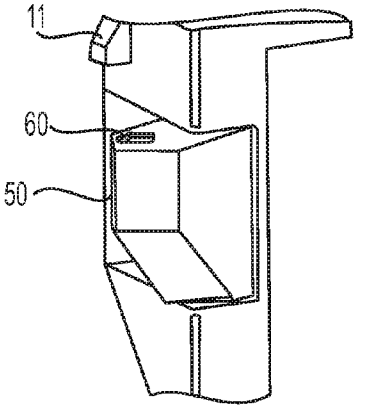

FIGS. 12-14 show a support 50 being turned toward an operative supporting position and also show a corner alignment ramps 11 near corners to aid alignment of closely spaced lid 20 over lower shell 30 when the lid 20 is in an upper opened position or is raised or lowered on the lower shell.

Figure 15:
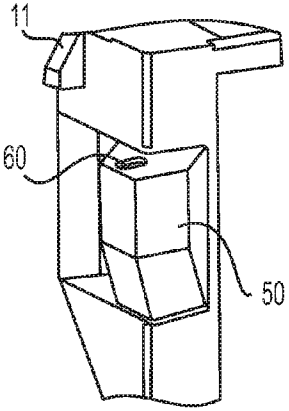

FIG. 15 shows the support 50 in full operative position.

Figure 16:
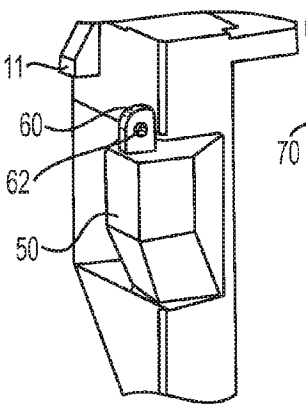

FIG. 16 shows the raised lug 60 with locking bar receiving hole 62.

Figure 17:
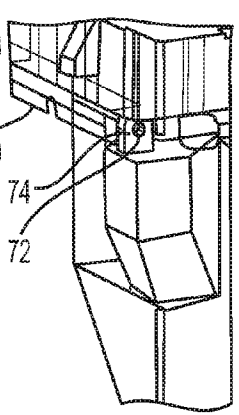

FIG. 17 shows the end 72 of the locking bar 74 slid into the receiving hole 62, which locks the raised lid 20 to the frame of the lower shell.

Figure 18:
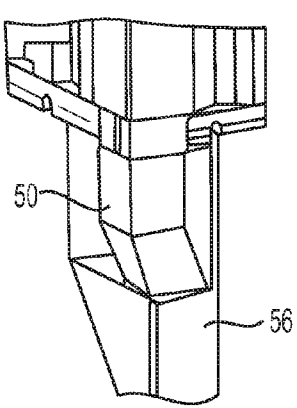

FIG. 18 shows the covered ends of the box beams 70. When the lug 60 is raised and the lid 20 is rested on the upper surfaces of the four corner supports 50, ends 72 of locking bars align with holes 62 in the supports. Locking levers extend the bars 74 outward, engaging the holes 62.

Figure 19:
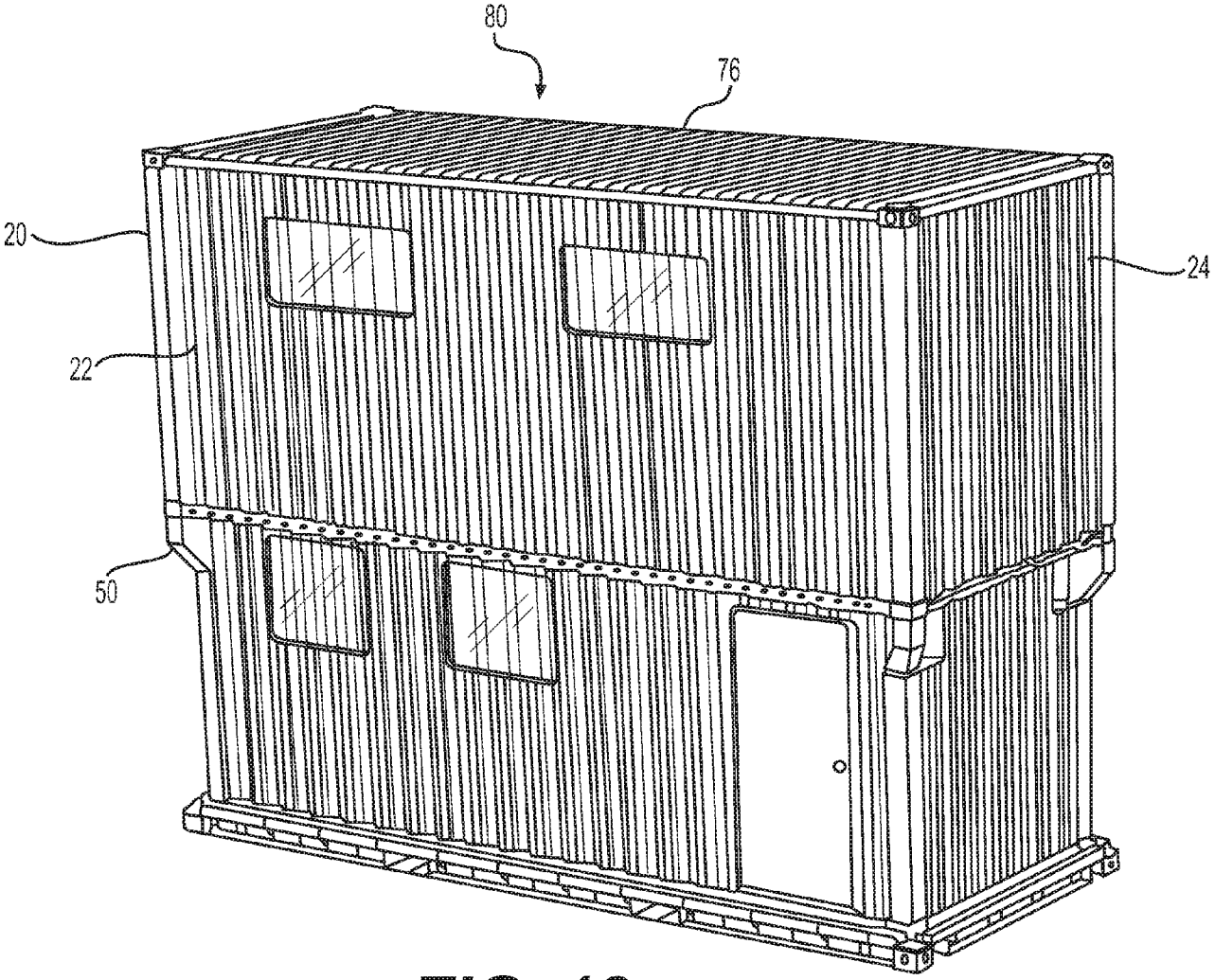
FIG. 19 shows a completed two-story building ready for use.

FIG. 19 shows a completed two-story building 80 ready for use. The roof on the building 80 is the top 76 of the lid 20. Second story outer walls are side walls 22 and end walls 24 of the lid 20. Supports 50 are extended and the door is ready to be opened for entering and using the building.

Figure 20:
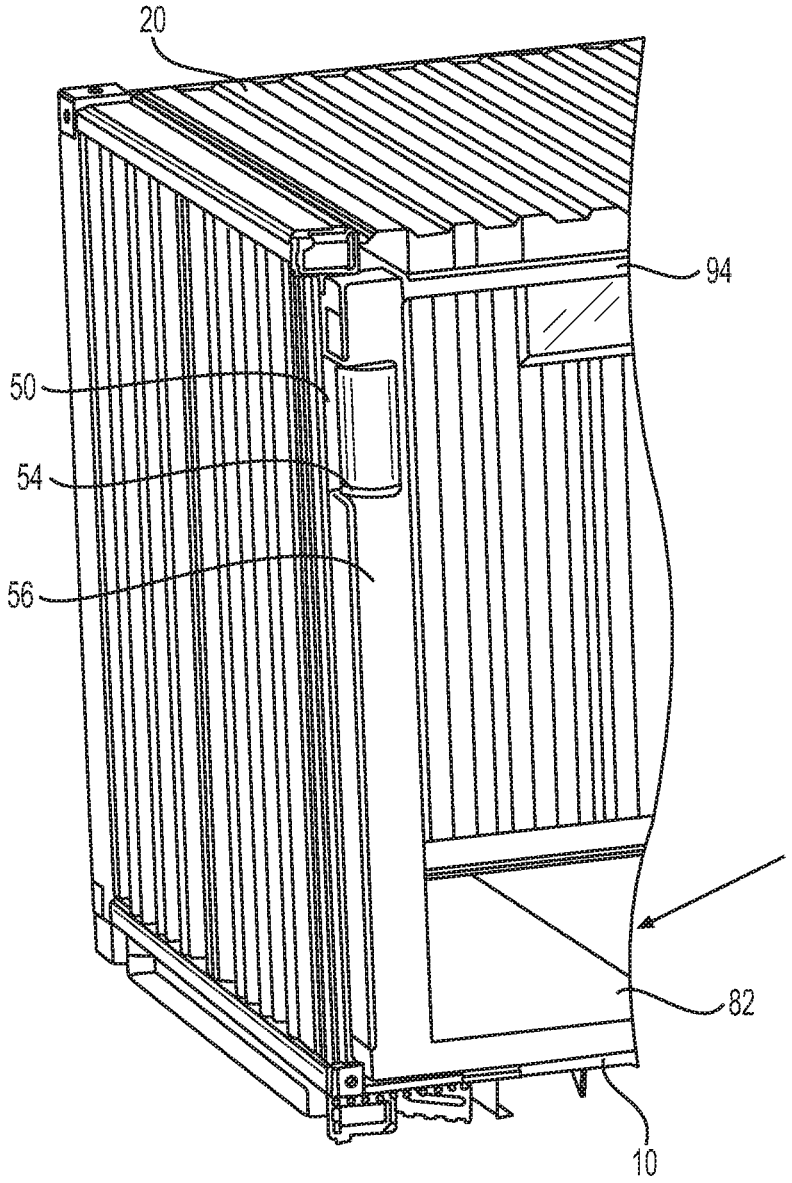
FIG. 20 is a cutaway corner view showing elements of the structure.

FIG. 20 is a cutaway corner view showing elements of the structure. The lower story vertical frame member support beam 56 has the recesses 54 which hold the turnable supports 50. The lower floor 82 of the building has been installed on the base 10. The second floor, normally mounted on the tops of the inner shell horizontal upper side frame members 94, is removed to show the structure.

Figure 21:
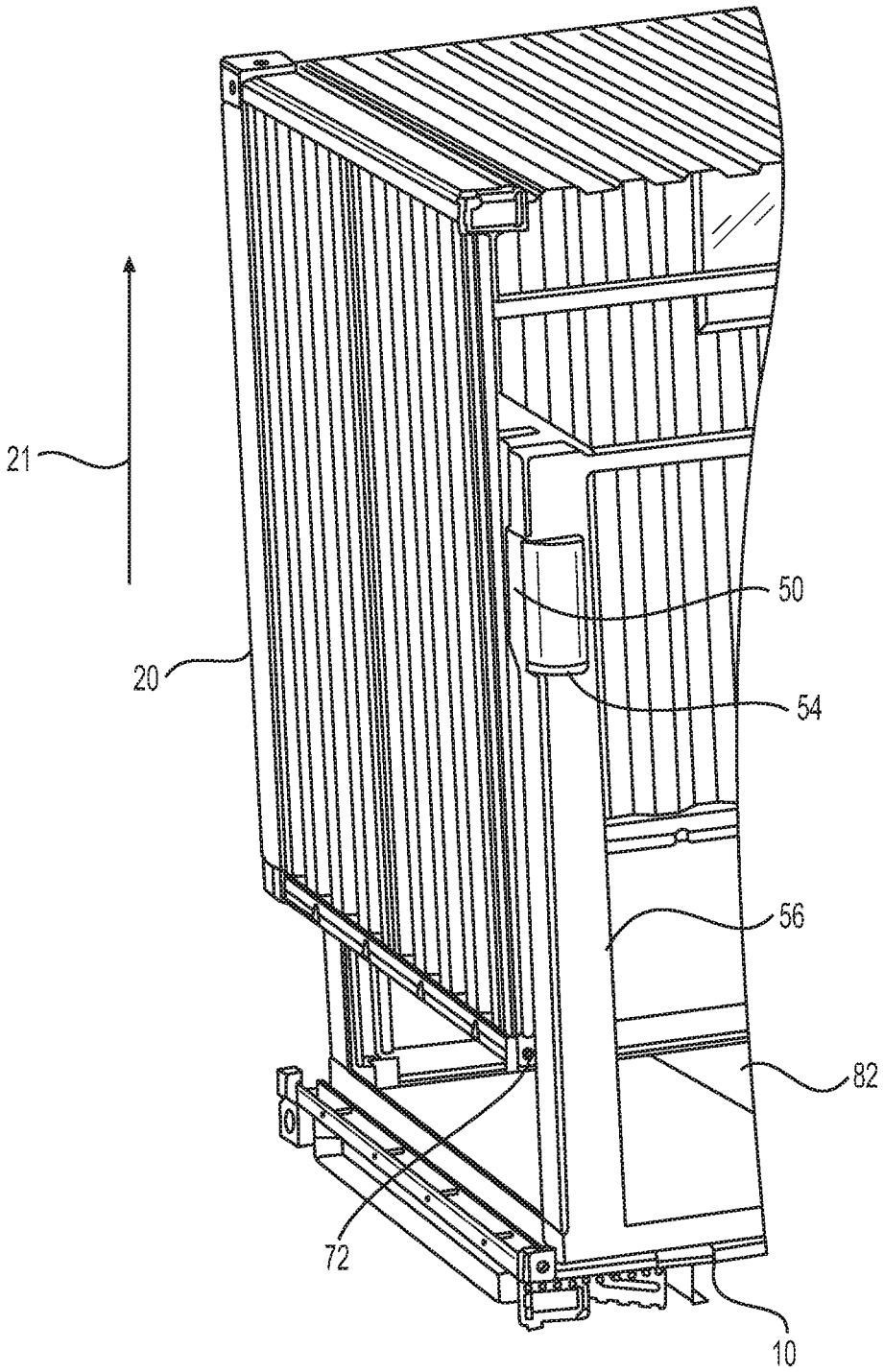
FIG. 21 is a cutaway corner view showing partial lifting of the lid which encloses the second floor.

FIG. 21 is a cutaway corner view showing partial lifting of the lid 20 that forms the roof and walls enclosing the second story of building 80. Arrow 21 shows the lifting of the lid. One vertical support beam 56 and its recess 54 holding one of the turnable supports 50 are shown. An end 72 of a sliding locking bar is shown.

Figure 22:
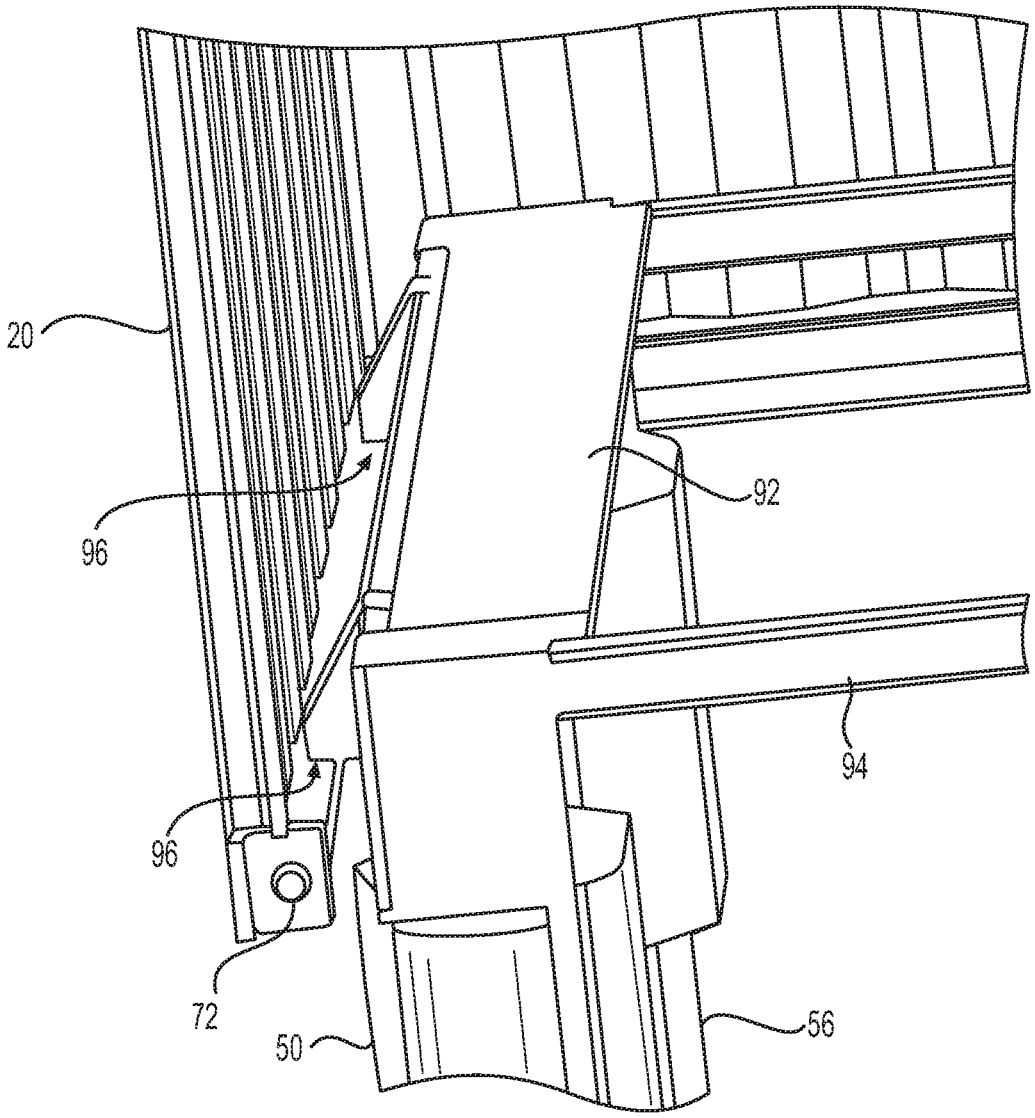
FIG. 22 is a cutaway corner view showing lifting of the top floor lid stopped by hard stops connected to the inner frame of the first floor.

FIG. 22 is a cutaway corner view showing that the lifting of the lid 20 is stopped by hard stops 96 connected to the inner horizontal upper end frame members 92 of the lower living area. The upper floor is supported on the long box beam frame members 94 which extend between end frame members 92.

Figure 25:
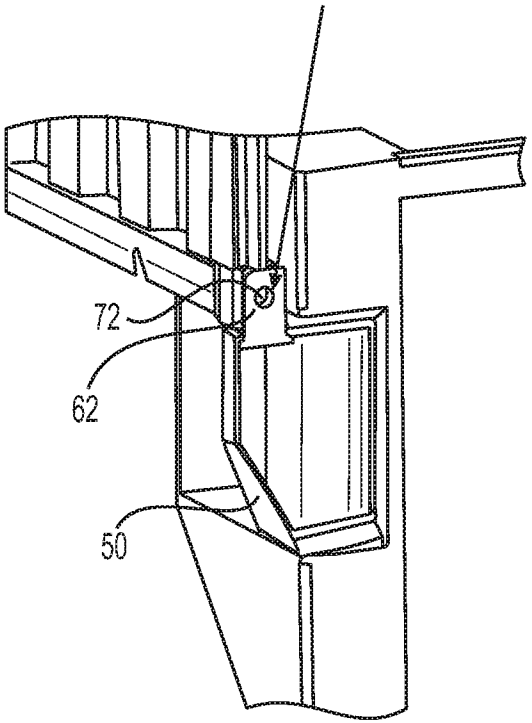
FIGS. 23-25 are partially cut away details of the corner supports that swing out and the locking tabs that extend to receive the sliding locking bars in lower ends of the lid that becomes the second floor.
Figure 24:
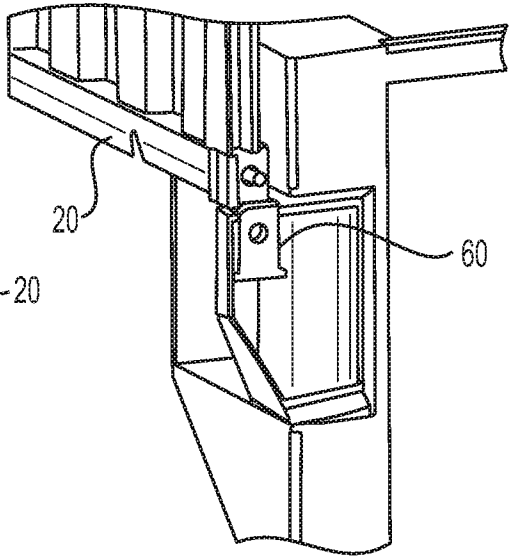
Figure 23:
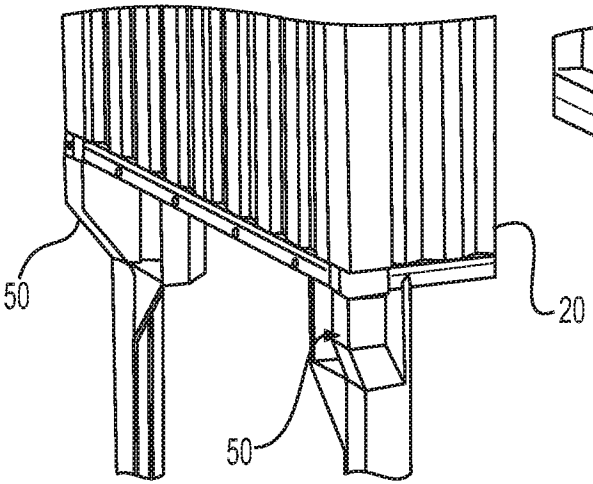

FIGS. 23-25 are partially cutaway details of the corner supports 50 that swing out and the locking lugs 60 that extend to receive ends 72 locking bars 74 sliding in or bolts extending from lower end box beams 70 of the lid 20 that becomes the second floor enclosure. The supports 50 have two positions—full in to allow vertical movement of lid 20 and full out to support the lid in its raised position. After the lid 20 is fully raised, the supports 50 are swiveled out and the locking lugs 60 are raised. The locking lugs are held in raised position by friction fit. After ends 72 of locking bars 74 are passed into openings 62 in lugs 60. The building 80 is ready to be furnished and used.

Figure 26:
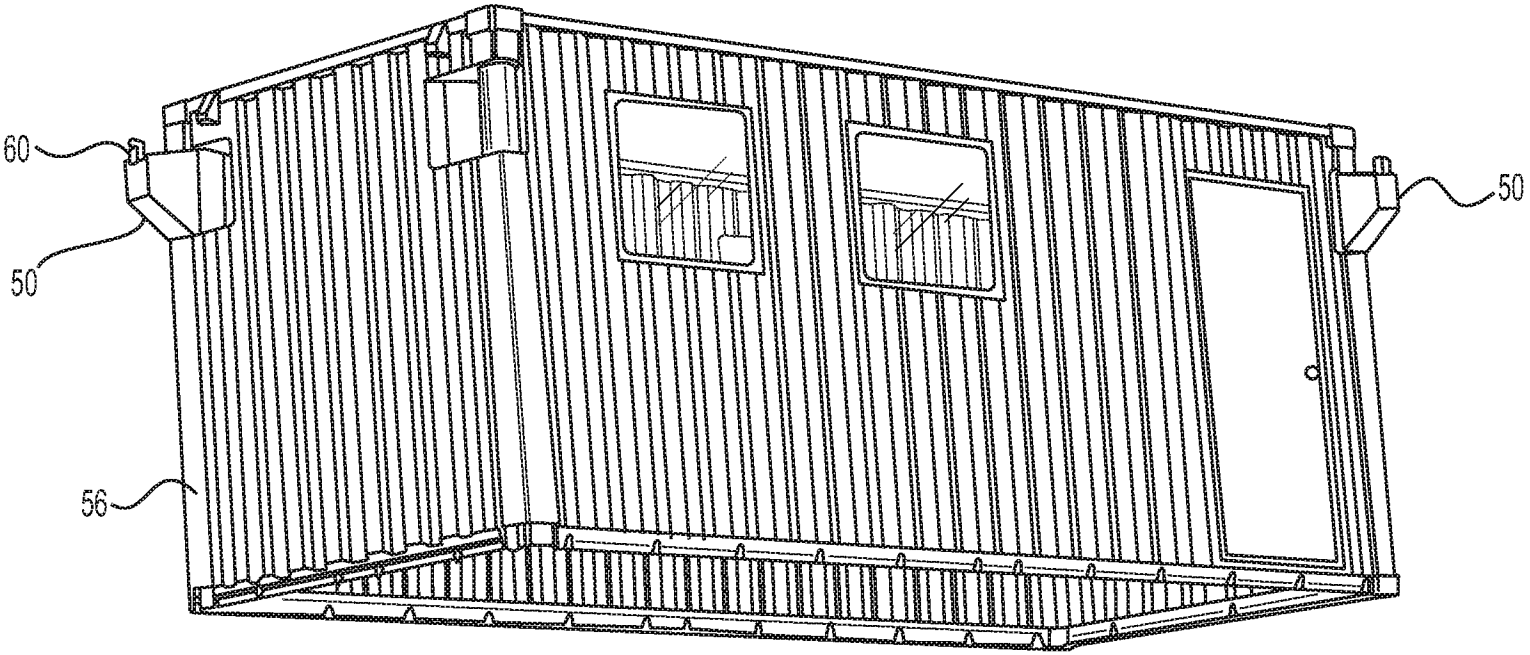
FIG. 26 is a perspective view showing the first floor frame and walls.

FIG. 26 is a perspective view showing the first floor frame and walls before upper and lower floors are added. The strong vertical support beams 56 and corrugated end and side walls of the lower structure are connected to the support beams 56 at corners of the structure. The horizontal connecting end and side beams are connected at the bottoms of the tops of the beams 56 and the walls.

Figure 27:
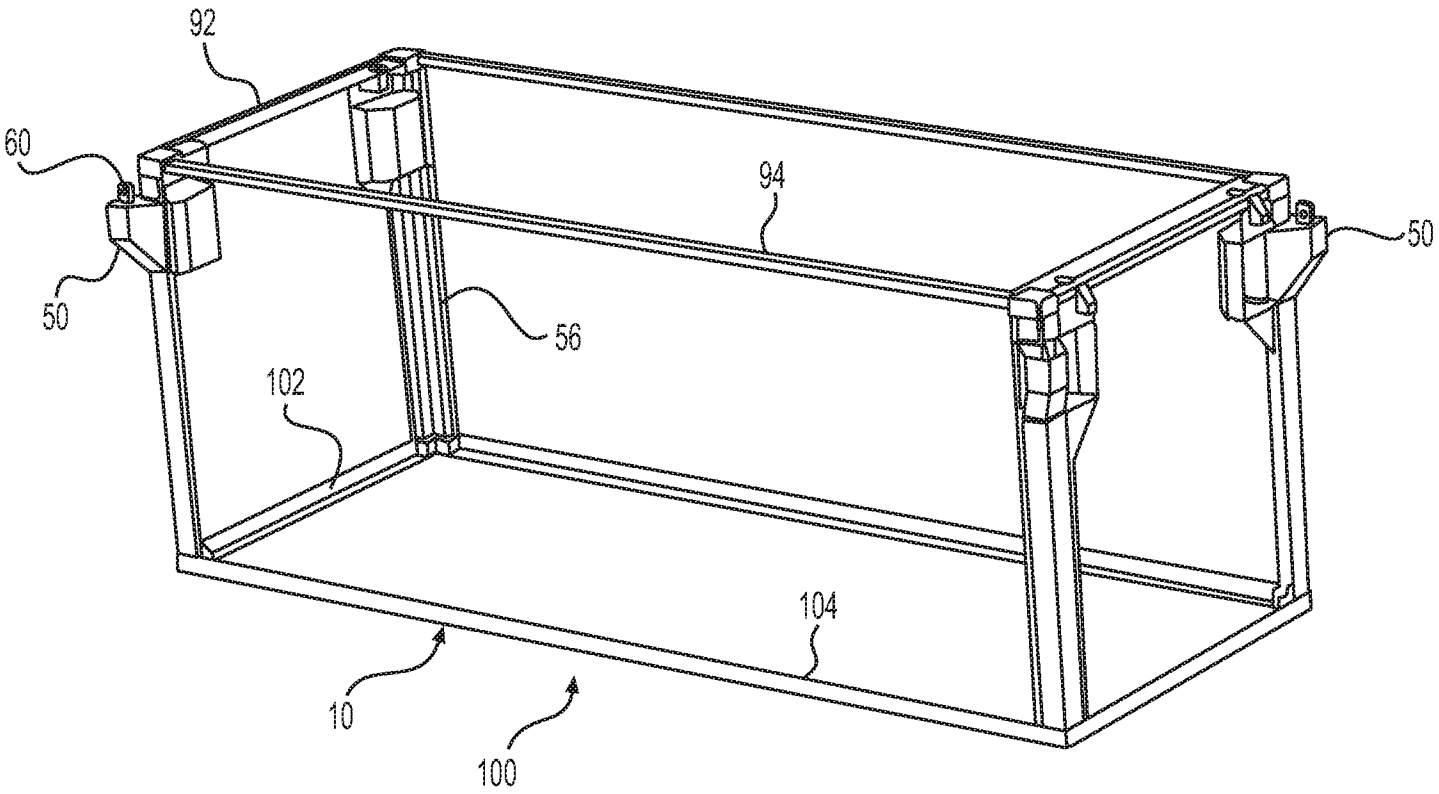
FIG. 27 shows the first floor frame with the swung-out second floor lid supports and the locking tabs.

FIG. 27 shows the first floor frame 100 with the strong support beams 56, the swung-out second floor lid supports and the locking lugs 60. The tops of the support beams 56 are connected by end box beams 92 and longer side beams 94. The base 10 is made of end box beams 102 and longer side beams 104.

Figure 29:
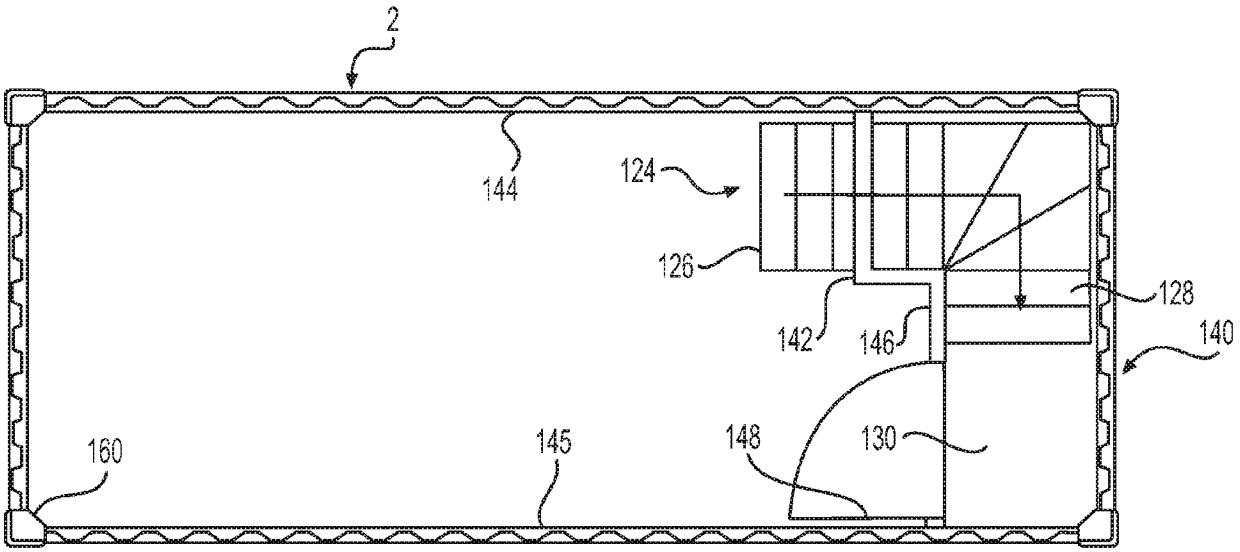
FIG. 29 is a plan view of an upper level of the expandable building.
Figure 28:
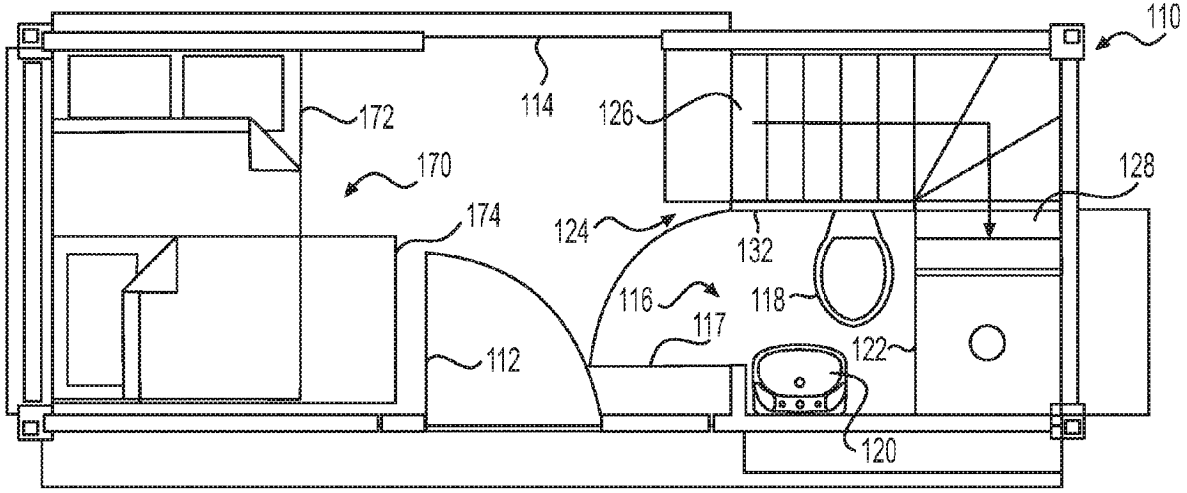
FIG. 28 is a plan view of a lower level of the expandable building.

In one interior of the expandable unit as FIGS. 28 and 29, when used as a residence, the base level 110 may have a central access door 112. Directly across from the door 112 a window 114 may be installed to provide daylight to the interior. To the right of the central access door 112 is a bathroom 116. A door 117 to the bathroom is provided for privacy. A toilet 118, sink 120 and shower 122 are installed and are connected to plumbing and holding tanks within a cabinet under the stairs 124. The plumbing and holding tanks and electrical and other connections are accessed through small doors 46 shown in FIG. 5. Stairs 124 have a lower flight 126 and an upper flight 128 leading to a platform landing 130 on the upper level. A wall 132 exists along the lower flight 126 of the stairs 124.

In the upper level 140 of the building, a wall 142 may be raised and secured to extend across from one side 144 to the opposite side 145 to block off the stairs 124. The raisable wall 142 has an indentation 146 that holds a frame for the upstairs door 148 to position the upstairs door at an edge of the landing 130 above the shower 122.

Figure 30:
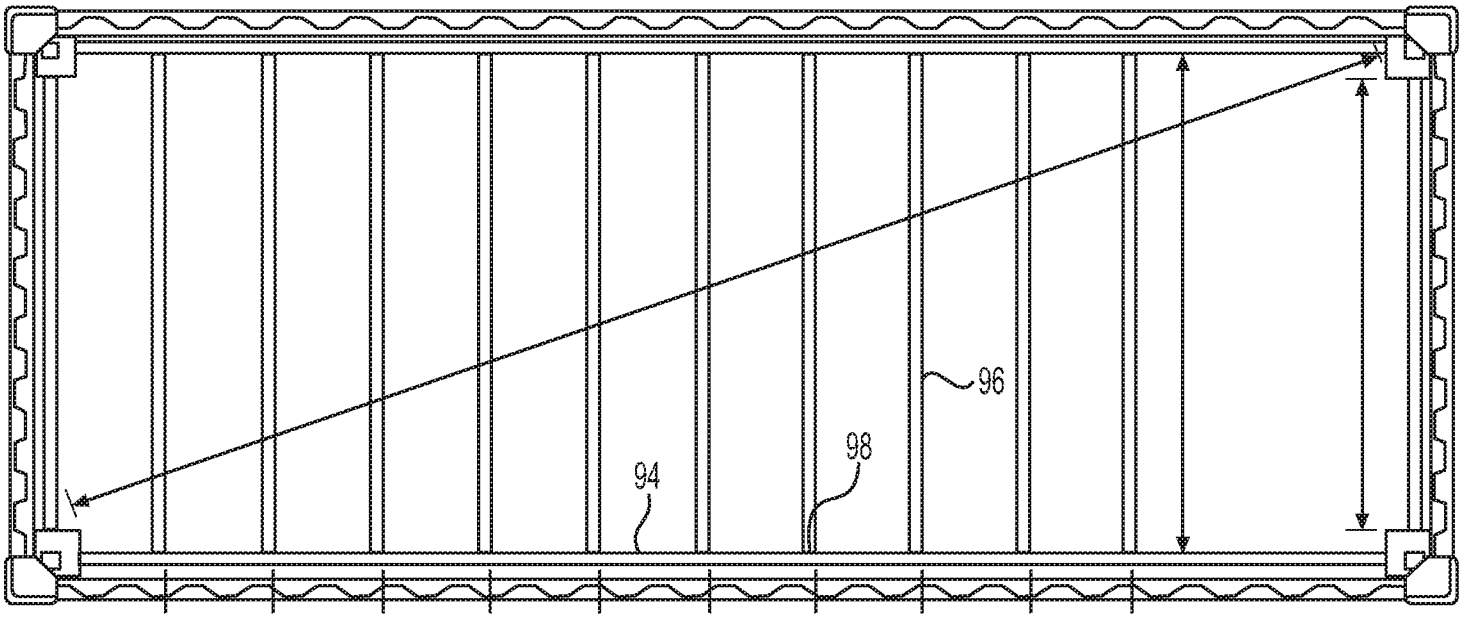
FIG. 30 shows the support structure for the upper floor.

The entire upper floor is supported by horizontal beams 92 and 94 that extend between tops of vertical support corner columns as shown in FIG. 27. Beams 96 as shown in FIG. 30 extend between the outer horizontal beams 94. Beams 96 have ends 98 supported by the horizontal beams 94, which may be channel beams with inward facing channels. Alternatively, hangers (not shown) may be welded to beams 94 to support ends 98 of cross beams 96.

Figure 31:
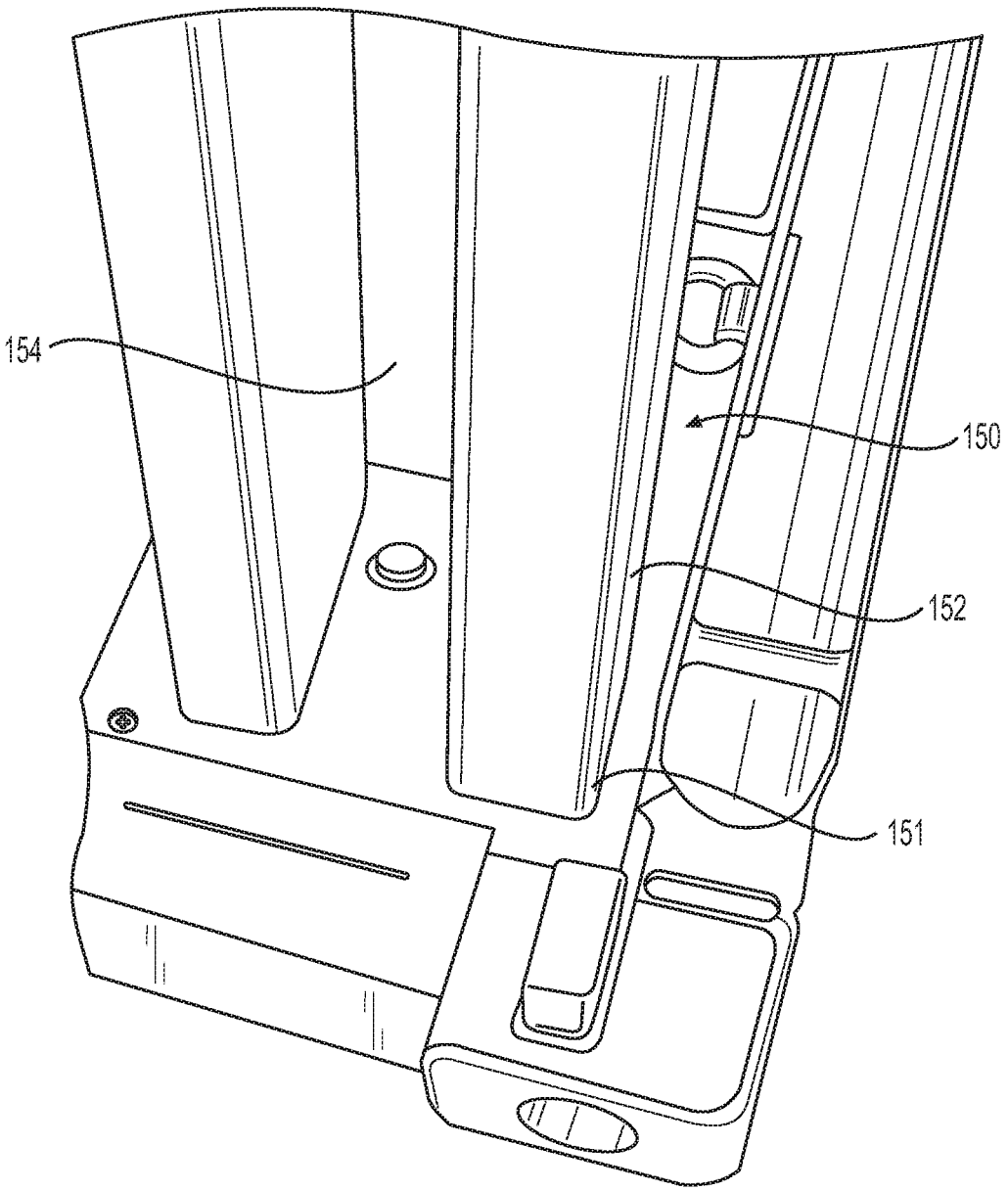
FIG. 31 shows lower portions of a vertical support columns on a base frame.

Lower portions 151 of the major vertical support columns 150 are shown in FIG. 31. Vertical box, channel or I-beams are joined 152, as shown. Spaces 154 between the parts of the beams are provided for positioning hydraulic actuators to raise and lower the upper part lid 2 of the houses.

Figure 32:
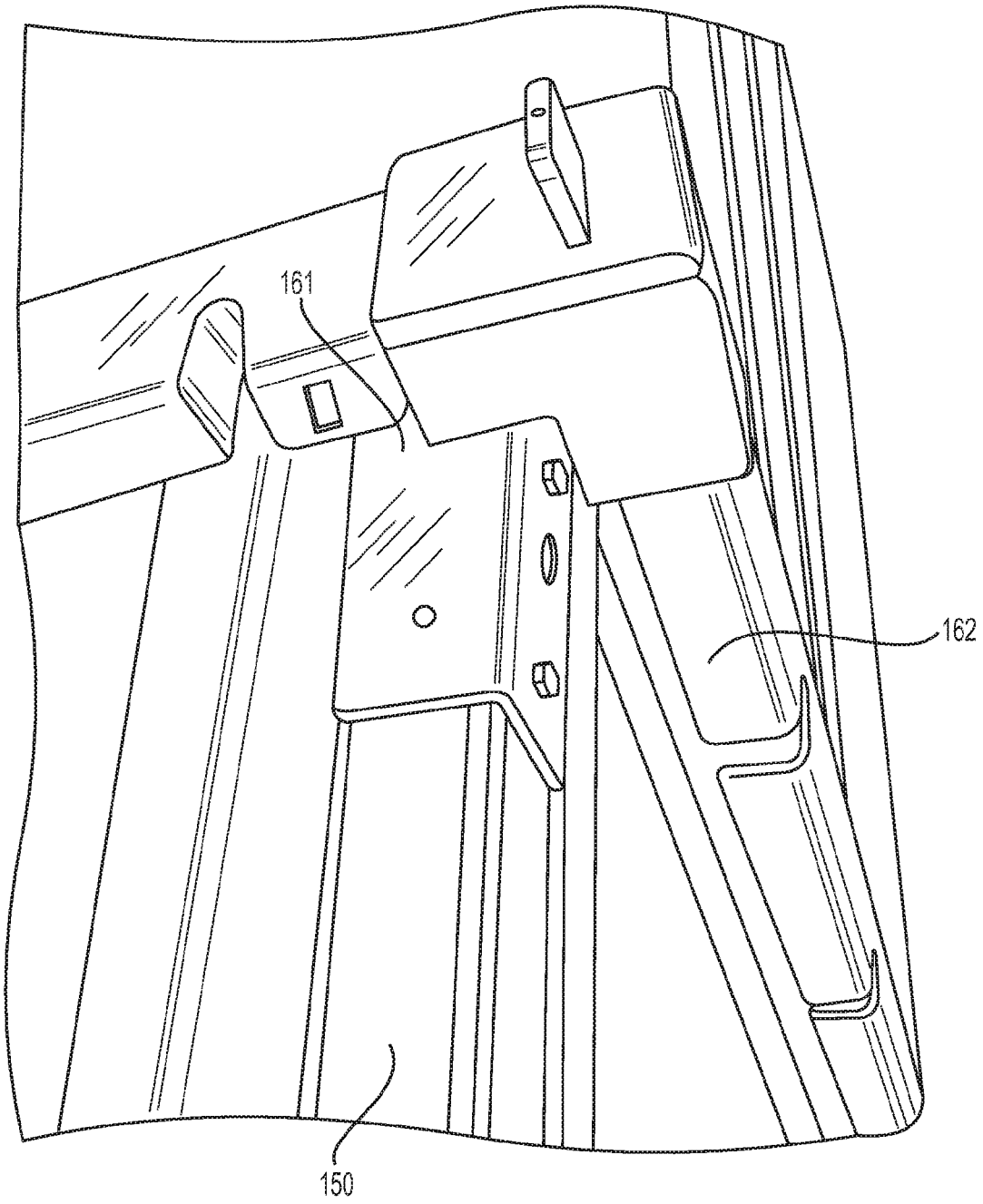
FIG. 32 shows downward extending connectors from the lid structure bolted to the corner columns on the base to hold the lid structure upward.

As shown in FIGS. 29 and 32, downward extending connectors 161 are connected to vertical pillars 160 which form inner corners of the lid 2 that forms the walls of the upper level 140. Downward extending connectors 161 are bolted 162 to the vertical support columns 150 when the upper level is in the proper upward position.

The lower level has furnishings 170 such as a lower double bed 172 and a loft or bunk single bed 174 above the lower bed, as shown in FIG. 28. Benches, tables and chairs may also be provided on the lower level. Furniture for use on the upper level such as small tables, chairs and flexible beds may be stored on the lower level for later use by carrying them up the stairway.

For emergency shelters, non-perishable stocks of food may be stored on the lower levels. Small electrical ranges and small refrigerators may be mounted on the lower level for storage and transportation to points of need. The lids may be lowered and locked to the frames. Corner pillars on the lid have upper and lower corner castings at ends. Lower corner castings are secured and locked on corner castings of the base frames. Second base frames of similar lowered and locked buildings may be stacked by connecting upper corner castings on the lid columns to lower corner castings on the next above base frames.

While the invention has been described with reference to specific embodiments, modifications and variations of the invention may be constructed without departing from the scope of the invention, which is defined in the following claims.

We claim:

1. An apparatus comprising:

a shipping container including an upward extensible building, further comprising:

a base frame having longitudinal side beams and end beams, cross beams extending between the longitudinal side beams, the cross beams including the end beams extending between ends of the side beams and intermediate beams extending between longitudinal beams spaced from the end beams, a lower floor on the cross beams, vertical columns having lower ends connected to the base frame and having upper ends, an upper frame connected to the upper ends of the vertical columns, a lid positioned around the vertical columns for moving upward to provide an upper level and downward to close upper level connectors connected to the lid for securing to the vertical columns and holding the lid in an upward position, the lid having four walls which are two opposite end walls and two opposite side walls, and four corners at intersections of the end and side walls, and the lid having a roof connected to the walls, four vertical pillars in the corners of the walls, lid upper and lower corner castings connected to tops and bottoms of the four vertical pillars, locks connected to the lid and the base frame for holding the lid in a downward position, the locks further comprising twist locks connectable to the lid lower corner castings and to base corner castings at the four corners of the lid structure, swingable brackets coupled to outer sides of the upper ends of the vertical columns for swinging out from stored positions to generally perpendicular to the stored positions for supporting the lid thereon in an upward position, and the portable extendable building configured for having a size comparable to an intermodal shipping container and adapted for stacking with another extensible building.

2. The apparatus of claim 1, further comprising an upper floor connected to the upper frame, a passageway between the lower floor and the upper floor, outer lower walls connected to the vertical columns, an entry door connected to one of the outer walls, and wherein the lid provides outer upper walls.

3. The apparatus of claim 2, further comprising a barrier erectable in the upper level separating the passageway from the upper floor.

4. The apparatus of claim 2, further comprising windows in the walls, and wherein the passageway comprises stairs between the lower floor and the upper floor.

5. The apparatus of claim 4, further comprising a bathroom on the lower floor, plumbing connections and tanks in a space below the stairs, and a door in the outer lower wall providing access to the plumbing connections and tanks.

6. The apparatus of claim 2, wherein the lid locked in the downward position surrounds the lower walls and prevents access to the extensible building.

7. The apparatus of claim 1, wherein the pillars are configured to slide over the vertical columns, and base corner castings connected to corners of the base frame, wherein the locks connect base corner castings with lower lid corner castings.

8. The apparatus of claim 2, wherein the extensible building is provided with a toilet, sink and shower on the lower floor and home or office furnishings on the lower floor, and furnishings to move through the passageway to the upper floor when the lid is secured in the upper position.

9. An apparatus comprising:

a shipping container including a portable extendable building having a lower level and an upper level, the lower level further comprising a base having a base frame with four corners, base corner castings at the four corners, vertical support columns connected to and extending upward from the base frame, horizontal upper frame members extending between and connected to tops of the vertical support columns, a lower floor connected to the base frame, an upper floor connected to the horizontal upper frame members, a passageway in the upper floor providing access to the upper floor from the lower floor, lower walls surrounding the horizontal upper frame members, the upper and lower floors, at least one door connected to the lower walls, a five-sided lid structure having four corners, first and second opposite side walls, first and second opposite end walls, and a roof connected to tops of the side walls and end walls, four vertical pillars in the corners of the walls, lid upper and lower corner castings connected to tops and bottoms of the four vertical pillars, the side walls and end walls of the lid structure being positionable outside the vertical support columns, the horizontal upper frame members and the upper floor, twist locks connectable to the lid lower corner castings and to the base corner castings at the four corners of the lid structure, the lid structure being raisable to and lockable in an upper position on the vertical support columns, further comprising connectors for securing the lid structure in the upper position, swingable brackets coupled to outer sides of the upper ends of the vertical pillars for swinging out from stored positions to generally perpendicular to the stored positions for supporting the lid thereon in the upper position, the lid being lowerable to a closed position on the base frame and being lockable to the base, the portable extendable building configured for having a size comparable to an intermodal shipping container and adapted for stacking with another extensible building, wherein the lid being lowered covers the lower walls and the door preventing access to an interior of the portable extendable building.

10. The apparatus of claim 9, further comprising stairs in the passageway between the first floor and the second floor, and a window in the lower walls, a bathroom on the lower floor, plumbing connections to the bathrooms and tanks on the lower floor beneath the stairs, and equipment access doors in one of the lower walls providing access to the plumbing connectors and tanks.

11. The apparatus of claim 10, further comprising furniture mounted on the lower floor and a space on the lower floor for stored upper floor furniture to be carried up the stairs to the upper floor.

12. The apparatus of claim 10, further comprising pillars within corners between the side walls and walls of the lid structure, the pillars movable along the vertical columns between the upper position and closed position.

13. The apparatus of claim 12, further comprising upper and lower corner castings at upper and lower ends of the pillars and complementary corner castings in the base for connecting and locking the lower corner castings on the pillars.

* * * * *